US008267018B2

(12) United States Patent
Gunn

(10) Patent No.: US 8,267,018 B2
(45) Date of Patent: Sep. 18, 2012

(54) LOAD SUPPORT

(76) Inventor: Peter George Gunn, Escaldes Engordany (AD)

( * ) Notice: Subject to any disclaimer, the term of this patent is extended or adjusted under 35 U.S.C. 154(b) by 214 days.

(21) Appl. No.: 12/739,662

(22) PCT Filed: Oct. 23, 2008

(86) PCT No.: PCT/GB2008/003591

§ 371 (c)(1),
(2), (4) Date: Apr. 23, 2010

(87) PCT Pub. No.: WO2009/053698

PCT Pub. Date: Apr. 30, 2009

(65) Prior Publication Data

US 2012/0017809 A1 Jan. 26, 2012

(30) Foreign Application Priority Data

Oct. 24, 2007 (GB) ..... 0720771.5

(51) Int. Cl.
*B65D 19/38* (2006.01)

(52) U.S. Cl. ..... 108/53.1; 108/54.1; 108/53.3; 108/51.11

(58) Field of Classification Search ..... 108/51.11, 108/53.1, 5.33, 53.5, 54.1, 55.1, 55.5, 57.2, 108/53.3; 414/286; 248/346.02; 206/386, 206/595, 598, 600

See application file for complete search history.

(56) References Cited

U.S. PATENT DOCUMENTS

| | | | | |
|---|---|---|---|---|
| 2,950,078 | A * | 8/1960 | Phillips | 108/53.1 |
| 3,348,723 | A * | 10/1967 | Wilson | 108/53.5 |
| 3,524,415 | A * | 8/1970 | Heiman | 108/53.3 |
| 3,726,236 | A * | 4/1973 | Colas | 108/51.11 |
| 3,753,407 | A * | 8/1973 | Tilseth | 108/53.3 |
| 4,344,368 | A * | 8/1982 | Remington et al. | 108/57.15 |
| 4,480,748 | A * | 11/1984 | Wind | 108/55.3 |
| 5,609,111 | A * | 3/1997 | Hasegawa et al. | 108/55.1 |
| 6,112,673 | A * | 9/2000 | Gomez | 108/56.1 |
| 6,199,487 | B1 * | 3/2001 | Coddington | 108/56.1 |
| 6,216,607 | B1 * | 4/2001 | Cuddy | 108/55.5 |

(Continued)

FOREIGN PATENT DOCUMENTS

FR 2491034 A 4/1982

(Continued)

OTHER PUBLICATIONS

Appelt, Lothar, International Search Report for PCT/GB2008/003591, Mar. 27, 2009.

*Primary Examiner* — Jose V Chen
(74) *Attorney, Agent, or Firm* — Chernoff, Vilhauer, McClung & Stenzel LLP

(57) ABSTRACT

Load supports (10), in the form of pallets, have a front plate (12), a rear plate (14), frame members (20) and an upper surface member (22). Two pallets (10) can come together as shown, one inverted relative to the other and can inter fit which results in space saving when the pallets (10) are not in use. For example, the dimensions of the front and rear plates (12, 14) allow the rear plates (14) to be received in-board of the front plates (12) and resting against the frame members (20) of the other pallet (10). Once inter fitted, the volume of the pallets (10) is less than the sum of the volume of two independent pallets.

17 Claims, 25 Drawing Sheets

U.S. PATENT DOCUMENTS

| | | | | |
|---|---|---|---|---|
| 6,257,152 | B1 * | 7/2001 | Liu | 108/53.3 |
| 6,273,006 | B1 * | 8/2001 | Reutter et al. | 108/53.1 |
| 6,402,167 | B1 * | 6/2002 | Calleja | 108/55.1 |
| 6,581,769 | B2 * | 6/2003 | Nist | 108/51.11 |
| 6,598,541 | B2 * | 7/2003 | Vilkki | 108/51.11 |
| 6,609,466 | B2 * | 8/2003 | Salmanson et al. | 108/55.1 |
| 6,792,879 | B2 * | 9/2004 | de Jong | 108/51.11 |
| 6,821,068 | B2 * | 11/2004 | Facey et al. | 108/55.1 |
| 6,863,003 | B2 * | 3/2005 | Grainger | 108/51.11 |
| 7,739,965 | B2 * | 6/2010 | Heinrichs et al. | 108/53.1 |
| 2001/0009639 | A1 * | 7/2001 | Gunn | 414/286 |
| 2003/0230691 | A1 * | 12/2003 | Shackleton | 108/51.11 |
| 2005/0081763 | A1 | 4/2005 | Ramirez von Holle | |
| 2007/0215015 | A1 * | 9/2007 | Heinrichs et al. | 108/53.1 |
| 2008/0250986 | A1 * | 10/2008 | Boon | 108/53.1 |
| 2012/0017809 | A1 * | 1/2012 | Gunn | 108/53.3 |

FOREIGN PATENT DOCUMENTS

| | | | |
|---|---|---|---|
| FR | 2503668 | A | 10/1982 |
| GB | 2175345 | A | 11/1986 |
| GB | 2436553 | A | 10/2007 |
| JP | 7101339 | A | 4/1995 |
| JP | 11159214 | A | 6/1999 |
| JP | 2003063531 | A | 3/2003 |

* cited by examiner

LOAD SUPPORT

This is a national stage application filed under 35 USC 371 based on International Application No. PCT/GB2008/003591 filed Oct. 23, 2008, and claims priority under 35 USC 119 of United Kingdom Patent Application No. 0720771.5 filed Oct. 24, 2007.

The present invention relates to load support and in particular, but not exclusively, to palletised loads of the type commonly stored on racking systems.

Examples of the present invention provide a load support comprising:

a first member extending along a first edge, region of the support;

a second member extending along a second edge region generally opposite to the first edge region;

at least one frame member extending between and attached to the first and second members;

the said members defining a supporting frame for bearing the weight of a load on the support, and wherein the supporting frame is interfittable with the supporting frame of an inverted other like load support to allow the supports to be nested when not in use.

The supporting frame may define a plane for load support, the plane being generally upwardly directed, during use. The first and second members may be bounded by the plane. The or at least one of the frame members may be bounded by the plane. The frame members may be exposed from above, to support a load resting directly on the frame members. Alternatively, the load support may further comprise an upper surface member supported by the supporting frame and providing the upper surface of the load support. The upper surface member may be a sheet member or may be a mesh member.

When the supporting frames of like load supports are interfitted, the first and second members of each load support may rest against the or a frame member of the other load support. The or each frame member may extend away from the plane for load support by a distance which is less than the distance by which the first and second members extend as aforesaid.

The first and/or second member may form a skirt which extends downwardly in use. There may be at least one aperture formed in the skirt, to receive a lifting tine. The first and second members may have aligned tine apertures. A guide member may be associated with the or each aperture, to maintain alignment of the tine, relative to the load support.

The load support may comprise engagement means which, in use, engage a racking system for mounting the load support on the racking system. The engagement means may be releasably lockable to retain the load support on the racking system. The engagement means may be biased to their locked condition. The engagement means may be releasable by interaction with a lifting tine introduced to lift the load support. The engagement means may comprise a movably mounted member positioned to be engaged by a tine introduced to lift the load support, a locking member having a locking position for locking the engagement means, and a release position, and a coupling arrangement between the movably mounted member and the locking member and operable to cause the locking member to move as the movably mounted member moves. The movably mounted member may be hingedly mounted. The coupling arrangement may serve to convert hinged movement of the movably mounted member to linear movement of the locking member. The coupling arrangement may be so arranged that movement of the locking member away from the locking position is resisted by pressing the movably mounted member to the position corresponding with the locking position of the locking member. The movably mounted member may be lockable in the position corresponding with the locking position of the locking member. The support may further comprise castors on which the support is supportable on the ground or other surface. The support may comprise slots operable to secure a strap for securing a load. The support may comprise a structure detachably mounted to the supporting frame to retain a load supported by the support.

In another aspect, examples of the invention provide a load support comprising engagement means which, in use, engage a racking system for mounting the load support and a supported load on the racking system, the engagement means being releasably lockable by interaction with a lifting tine introduced to lift the load support.

Examples of the second aspect of the invention may incorporate any or all of the features set out above in relation to the first aspect.

Embodiments of the present invention will now be described in more detail, by way of example only, and with reference to the accompanying drawings, in which.

OVERVIEW

Figure 1:
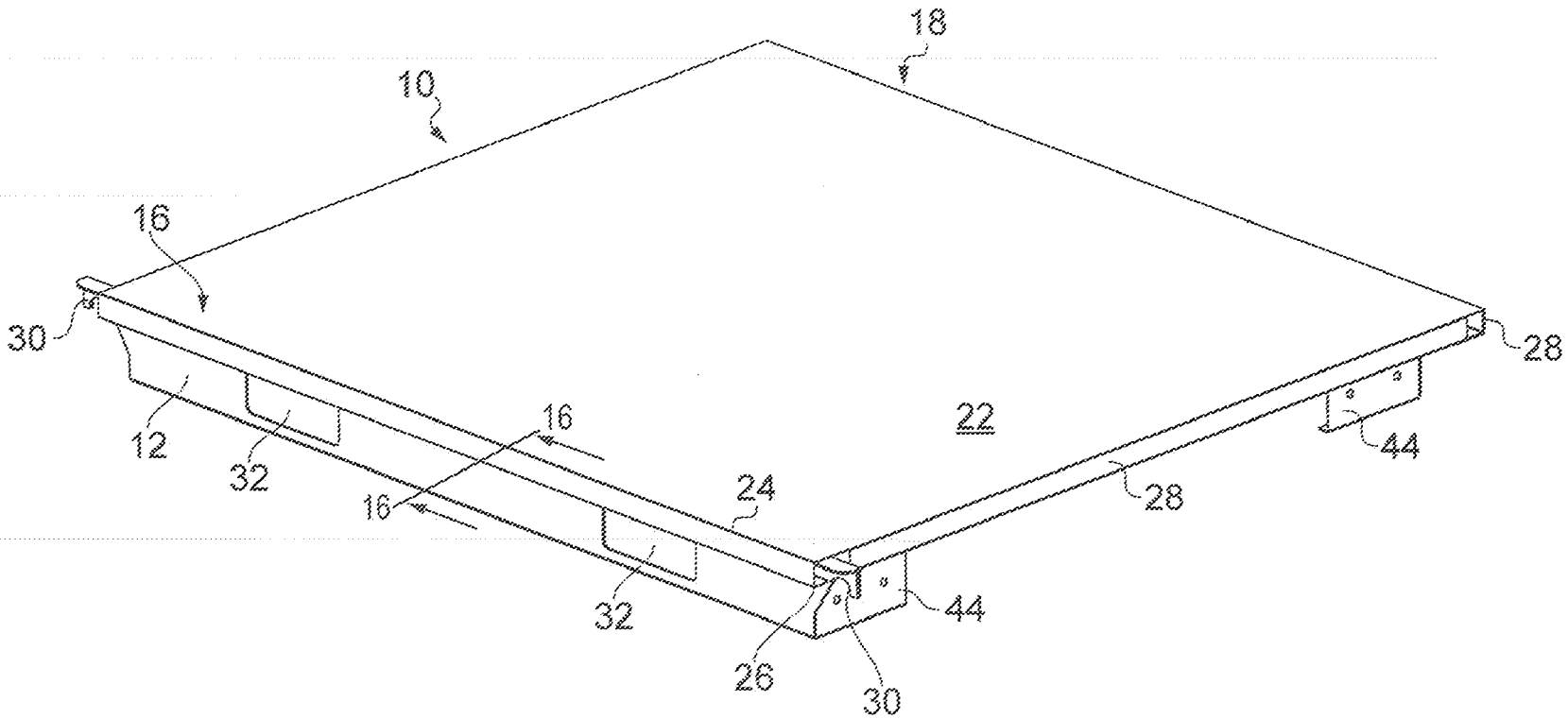
FIG. 1 is a perspective view of a load support.
Figure 2:
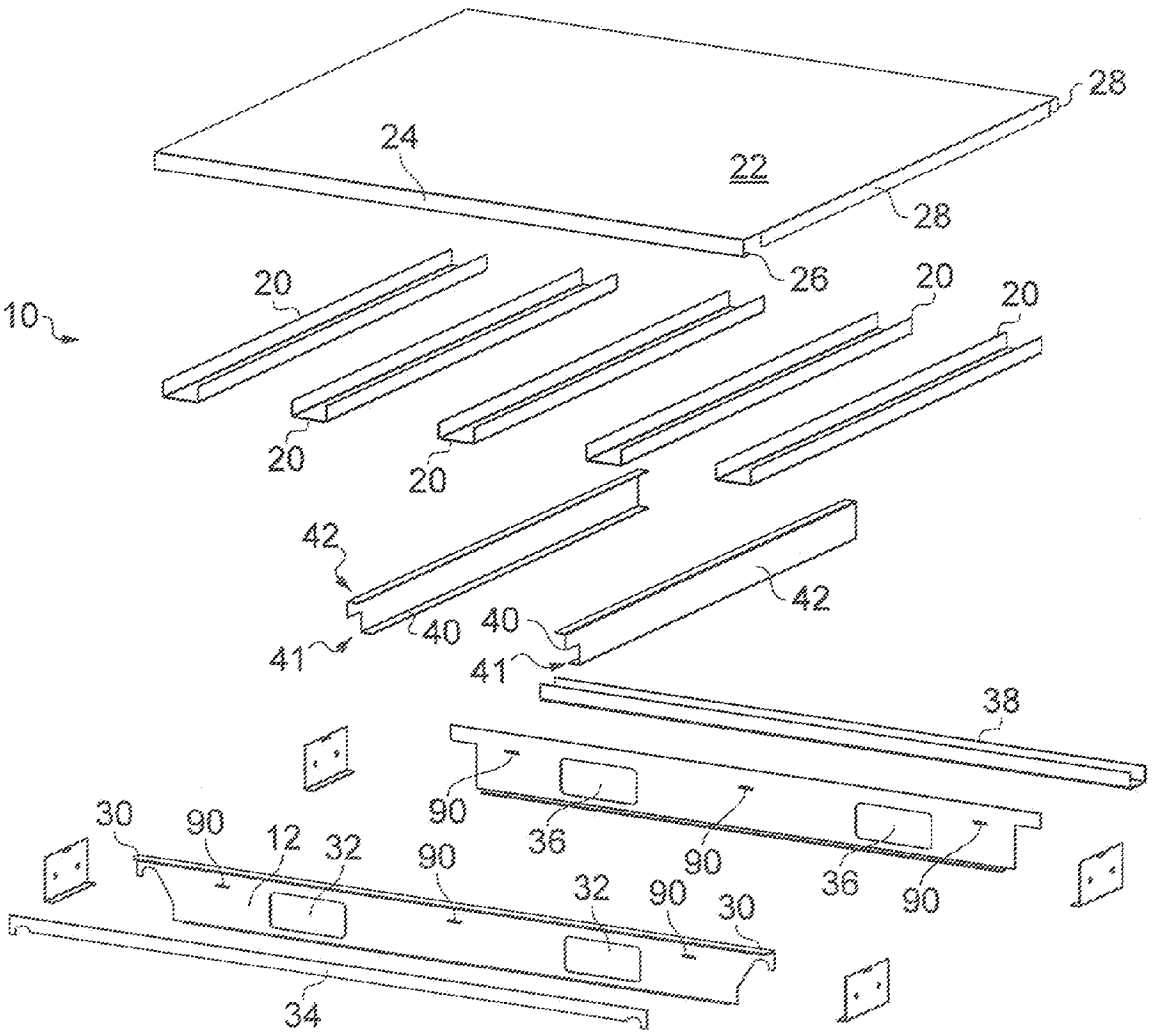
FIG. 2 is an exploded view of the load support of FIG. 1, showing its constituent components.
Figure 3:
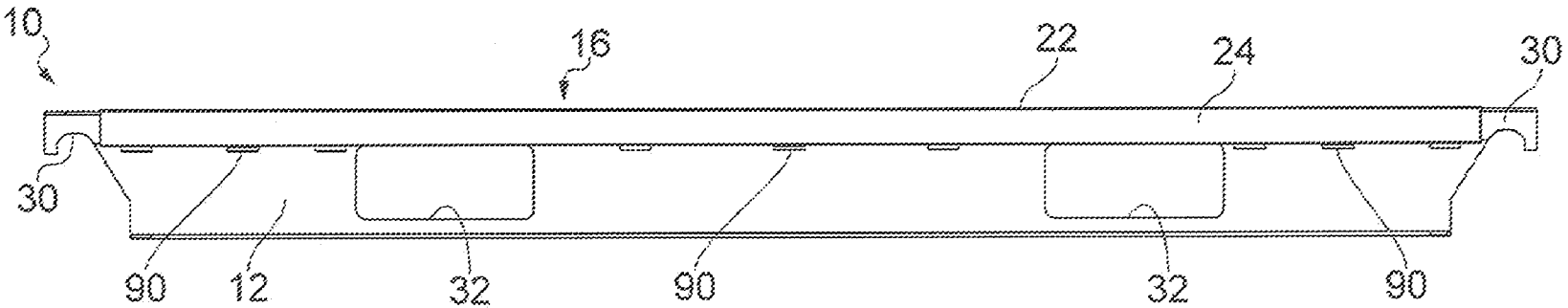
FIGS. 3, 4 and 5 are, respectively, front, side and rear elevations of the load support of FIG. 1.
Figure 4:
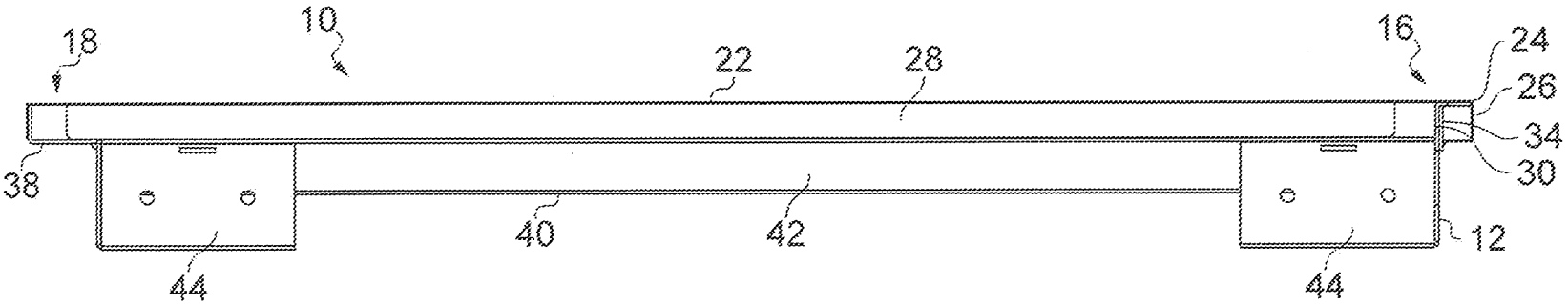
Figure 5:
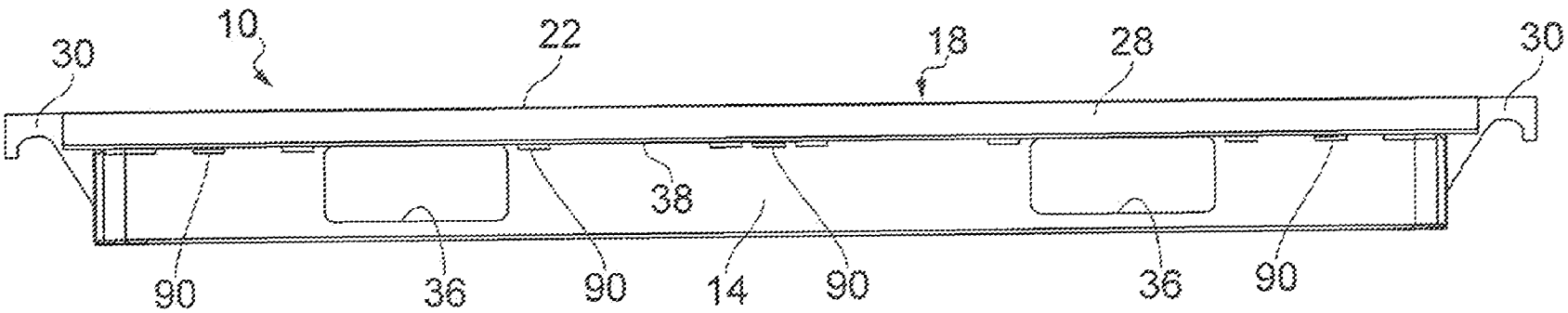

Turning in particular to FIGS. 1 to 7, the drawings show a load support 10. In the following description, the load support 10 will be referred to as a pallet, indicating that it is intended to support a load and to be moved in order to move the load. Alternatively, the load support 10 may be used as a shelf on a racking system, with the intention that the shelf remains in the racking system, and the supported load is moved by removing it from the shelf. A shelf could be used to support a conventional pallet and its load. It is to be understood that any of the features described could be implemented in an article primarily intended as a pallet or as a shelf.

The pallet 10 comprises a first member 12, here termed a front plate, and a second member 14, here termed a rear plate. The front plate 12 extends along the front edge region 16 of the pallet 10. The rear plate 14 extends along the rear edge region 18 of the pallet 10. Five frame members 20 extend between the front and rear plates 12, 14 and are attached to them. The plates 12, 14 and members 20 together form a supporting frame capable of bearing the weight of a load resting on the pallet 10.

The pallet is covered by an upper surface member 22 in the form of a sheet member, which may have apertures (not shown) or may be formed of mesh.

Figure 6:
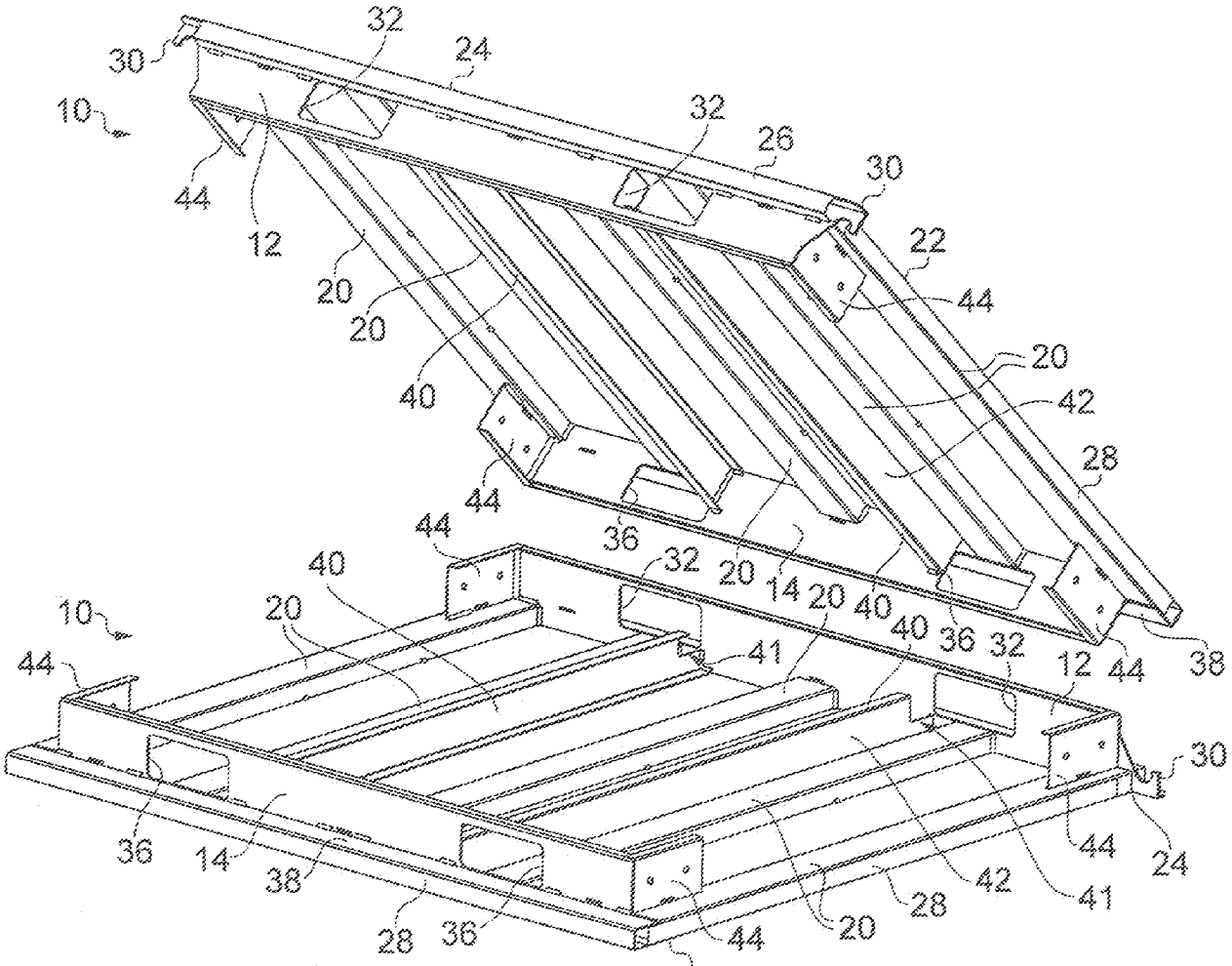
FIG. 6 is a perspective view of two load supports of the type shown in FIG. 1, being introduced for interfitting.
Figure 7:
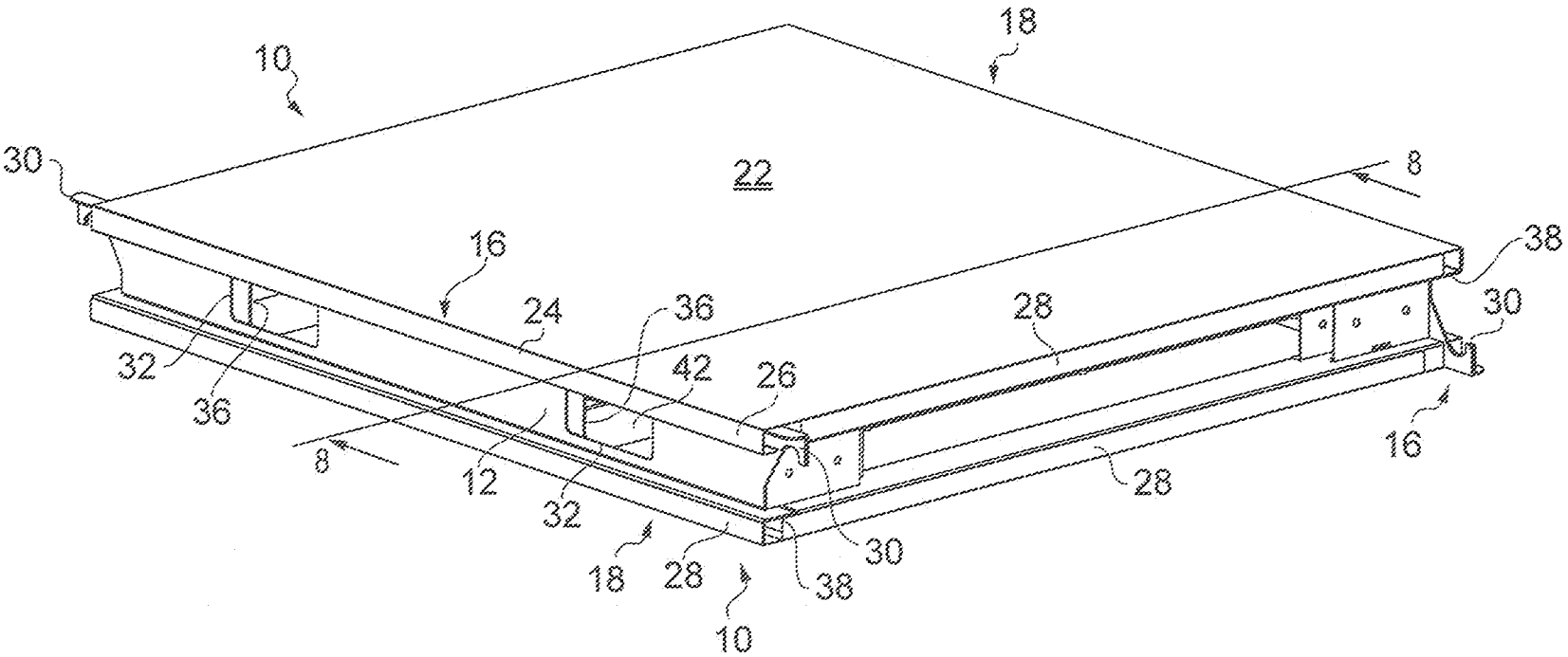
FIG. 7 illustrates the two load supports of FIG. 6, fully interfitted.

The supporting frame formed by the plates 12, 14 and members 20 is interfittable, as will be described, with the supporting frame of an inverted other pallet 10. Two pallets 10 are shown coming together in FIG. 6, one being inverted relative, to the other, and the fully interfitted condition is illustrated in FIG. 7. The interfitting allows the pallets 10 to be nested, when not in use, in a manner which will be described in more detail and which results in space saving which will also be further described.

Pallet Construction

The sheet member 22 is a generally planar sheet of metal, in this example. In normal use, the sheet 22 is generally horizontal. At the front edge 16, the edge of the sheet 12 is turned down at 24 and then returns at 26 (most clearly seen in FIG. 15), to form a channel section. The rear and side edges of the sheet 22 are also turned down to provide depending flanges 28.

The front plate 12 is generally planar and arranged generally vertically. Each end of the front plate 12 forms a hook. Two rectangular apertures 32 are provided, symmetrically disposed about the centre of the front plate 12. The front plate 12 is attached along its top edge to the underside of the sheet 22, with the hooks 30 projecting beyond the sheet 22, through gaps between the return 26 and the side flanges 28. An additional strengthening bar is attached to the front plate 12 and sheet 22 to extend along the whole length of the front plate 12, including the hooks 30. Accordingly, the ends of the strengthening bar 34 are also formed with the same hook profile as the plate 12. The bar 34 is located above the upper edges of the apertures 32, so that the apertures are not obstructed.

The rear plate 14 extends generally vertically and is attached along its upper edge to the underside of the sheet 22. Two further apertures 36 are formed in the rear plate 14. These are symmetrically disposed about the centre of the rear plate 14 and are aligned with the apertures 32. It can be seen, for example from FIG. 6, that the front and rear plates 12, 14 both form skirts which extend downwardly, in use, from the sheet 22, to provide aligned apertures 32, 36 below the sheet 22. The apertures 32, 36 are for receiving lifting tines, as will be described.

The height of the front and rear plates 12, 14 are substantially the same, so that the sheet member is generally horizontal when the pallet 10 is on a horizontal surface.

A strengthening channel member 38 is provided along the upper edge of the rear plate 14, secured to the plate 14 and the underside of the sheet 22. The lower face of the members 38 is coplanar with the lower face of the frame members 20.

The frame members 20 run parallel to each other, from the front plate 12 to the rear plate 14 and are attached to the front and rear plates 12, 14, for example by welding. The plates 12, 14 and the members 20 together form a strong frame capable of supporting the weight of loads. The frame members 20 are in channel section for added strength and are attached along their 20 upper edges to the underside of the sheet 22. Two of the frame members 20 lie along the side edges of the pallet 10, one lies along the central axis between the apertures 32, 36 and two further members 20 extend between the regions of apertures 32 and of the apertures 36.

As has been noted, the front plate 12, rear plate 14 and frame members 20 are all secured to the underside of the sheet 22. The underside of the sheet 22 therefore defines a plane by which the members are bounded. The plane of the sheet 22 also defines the plane on which a load will be supported. The frame members 20 extend away from this plane (downwardly, in a normal orientation) by a distance which is less than the distance by which the front and rear plates 12, 14 extend, as can be seen in FIG. 6. In particular, the frame members 20 do not obstruct the apertures 32, 36.

The pallet 10 also includes guide members 40 extending from the front plate 12 to the rear plate 14 alongside respective apertures 32, 34. The guide members 40 extend downwardly from the sheet 22 by a greater distance than the frame members 20. The guide members 40 have rebates 41 formed at one end, adjacent the front plate 12. The innermost extremity of each rebate 41 is coplanar with the lower faces of the frame members 20. The guide members 40 extend down by a distance which is sufficient for each of the guide members 40 to provide a guide surface 42 to engage a tine, such as the tine of a fork truck or other handling machine, introduced through one of the apertures 32, 36. In normal use, two parallel tines would be introduced through the apertures 32 or through the apertures 36. Each tine would extend alongside the corresponding guide surface 42. In the event of any misalignment between the tines and the pallet 10, the tines will engage the guide surface 42 as the tines are further introduced into the apertures 32, 36. This ensures correct alignment between the tines and the pallet, as the tines are introduced. Thereafter, engagement between the tines and the guide surfaces 42 ensures that correct alignment is maintained, by preventing the pallet twisting or otherwise moving relative to the tines.

Introduction of tines is further improved by the presence of a frame member 20 above each aperture 32, 36 and having a lower face aligned with the top edge of the aperture. This provides a surface under which the tine can slide as it is introduced, and which will rest on the tine as the pallet is lifted.

Four side gussets 44 are provided in the corners of the pallet, two extending back from the front plate 12, and two extending forward from the rear plate 14, to form a continuation of the skirt provided by the front plate and rear plate 12, 14, respectively. These further improve reinforcement and stability of the pallet, during use.

Interfitting

Figure 8:
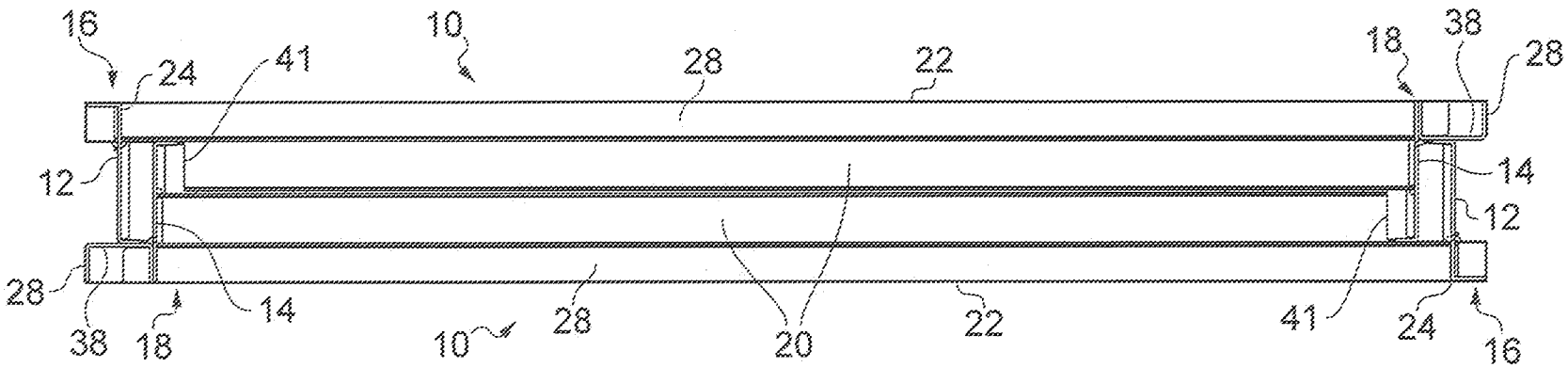
FIG. 8 is a section of the interfitted load supports of FIG. 7, along the line 8-8 of FIG. 7.

Having described the construction of the pallet 10, the manner of interfitting can now be described, with particular reference to FIGS. 6, 7 and 8.

In FIG. 6, two pallets 10, which are alike, are shown. The lower pallet 10 is upside down relative to the normal use, with the sheet 22 lowermost. The upper pallet 10 is being introduced from above. As the upper pallet 10 is lowered to a position parallel with the lower pallet 10, the pallets adopt positions which are rotated, one from the other, by 180° around a horizontal axis extending from side to side on each pallet 10, parallel with the front and rear plates 12, 14. Consequently, the front plate 12 of the upper pallet approaches the rear plate 14 of the lower pallet and vice versa. However, the length of the rear plate 14 is shorter than the length of the front plate 12. Consequently, the rear plate 14 and corresponding gussets 44 can be received in-board of the front plate 12 and corresponding gussets 44 of the other pallet. This also places the rear plate 14 in the rebates 41 of the guide members 40 of the other pallet. The upper pallet can then be lowered until the exposed edges of the rear plates 14 rest against the frame members 20, in the rebates 41. Once interfitted in this way, as illustrated in FIG. 7, the total volume of the pallets 10 is less than the sum of the volume of two independent pallets, because of the nesting of the front and rear plates, as has been described. The volume saving depends on the depth by which the plates 12, 14 nest before the rear plates 14 meet the frame members 20.

The volume saving achieved by nesting the pallets 10 allows them to be stored and transported more compactly, when not in use for load support, than if interfitting and/or nesting was not possible.

Load Support and Racking

When a pallet is to be used for load support in a racking system, the hooks 30 and strengthening bar 34 provide engagement features allowing the pallet 10 to be hung on a racking system. In particular, the pallets being described are envisaged for use with a racking system which provides a ledge on which the strengthening bar 38 may rest to support the rear of the pallet 10, and pegs or hooks over which the hooks 30 may engage to support the front of the pallet 10. Consequently, the supporting frame formed by the front and rear plates 12, 14 and frame members 20 is directly supported by the racking system and, in turn, supports the weight of the load on the pallet 10.

The pallet 10 can be lifted on or off the racking system by introducing tines into the apertures 32 or 36.

Locking Mechanism

The pallet 10 described above may be modified to incorporate a locking arrangement, which will now be described by reference to FIGS. 9 to 14. This description and the associated drawings relate to a locking arrangement provided at one end of the front plate 12. It will be generally desirable to provide a corresponding locking arrangement at the other end of the front plate 12.

Figure 9:
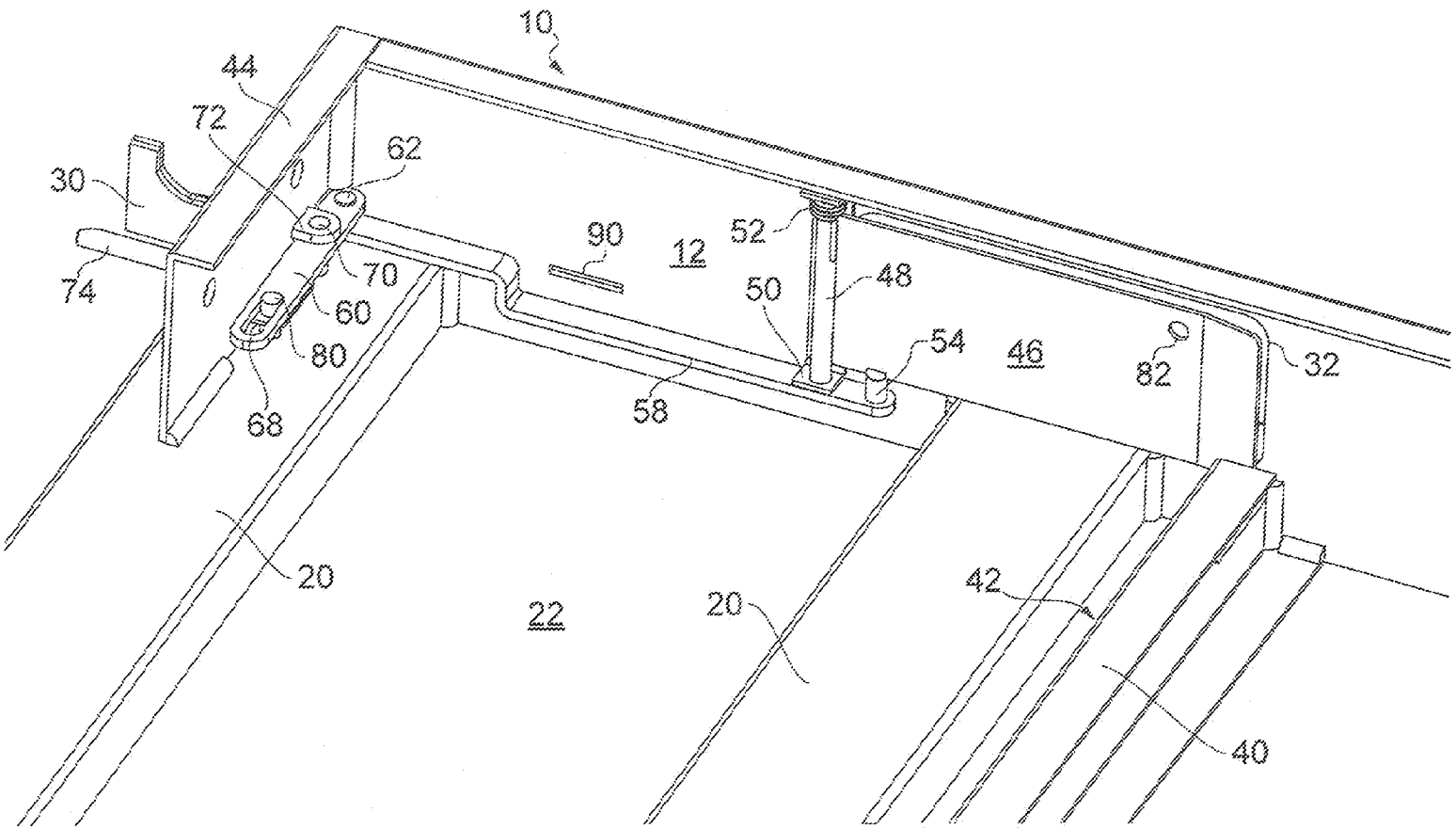
FIG. 9 is a partial and enlarged perspective view of an inverted load support, illustrating a releasable locking arrangement.
Figure 10:
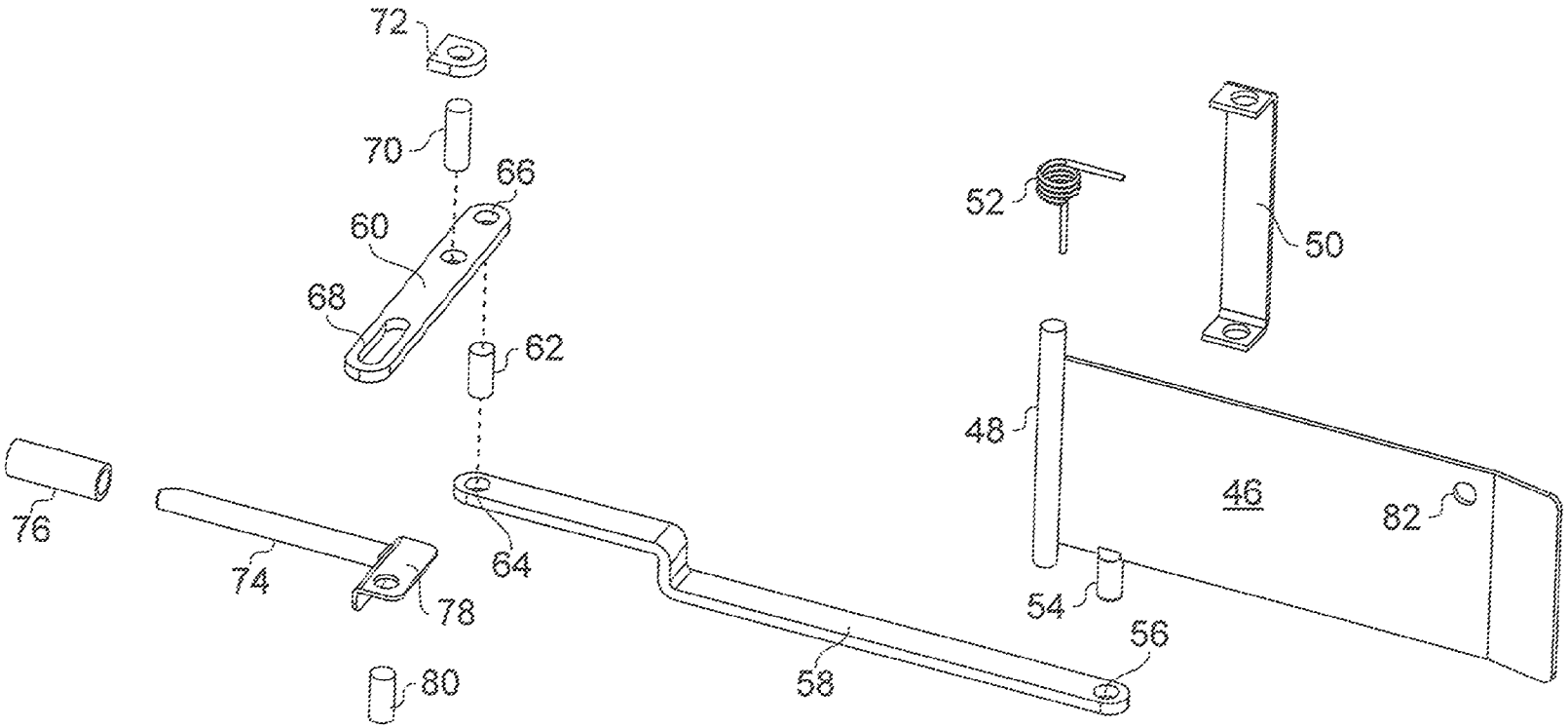
FIG. 10 is an exploded view of components of the locking mechanism.
Figure 11:
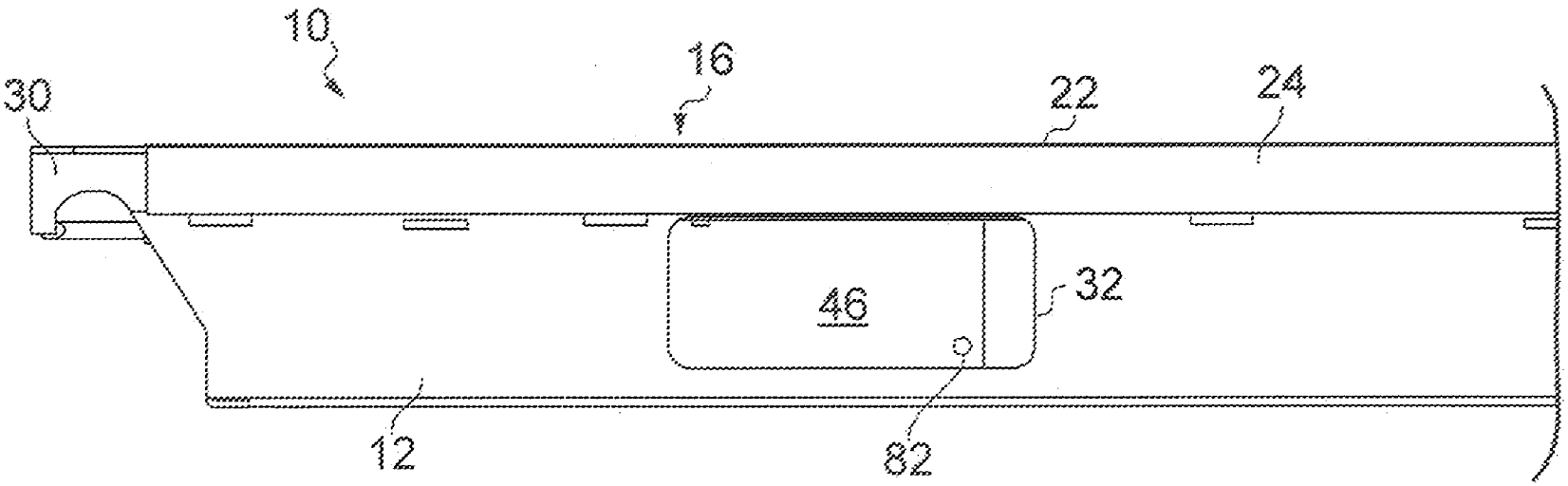
FIG. 11 is a partial front elevation of a load support, illustrating features of the locking mechanism.

Referring in particular to FIGS. 9 and 10, the locking arrangement includes a plate 46 having a pivot bar 48 at one end and supported by means of a mounting bracket 50 to the front plate 12, adjacent the aperture 32. The plate 46 is thus hingedly mounted to move from a position closing the corresponding aperture 32, to a position away from the aperture 32. A torsion spring 52 is incorporated within the mounting arrangement, to urge the plate 46 to a position in which the aperture 32 is closed.

A pin 54 extends from the plate 46, parallel with but spaced from the pivot bar 48 and is received in an aperture 56 in one end of a first bar 58. The pin 54 and aperture 56 provide a pivotal connection between the first bar 58 and the plate 46. A similar pivotal connection is provided at the other end of the first bar 58, between the first bar 58 and one end of a second bar 60, by means of a pin 62 received in apertures 64, 66 in the first and second bars 58, 60 respectively. At its other end, the second bar 60 has an elongate slot 68. Intermediate the two ends, the second bar 60 is pivotally mounted by a pin 70 and bracket 72 to the side gusset 44.

Figure 12:
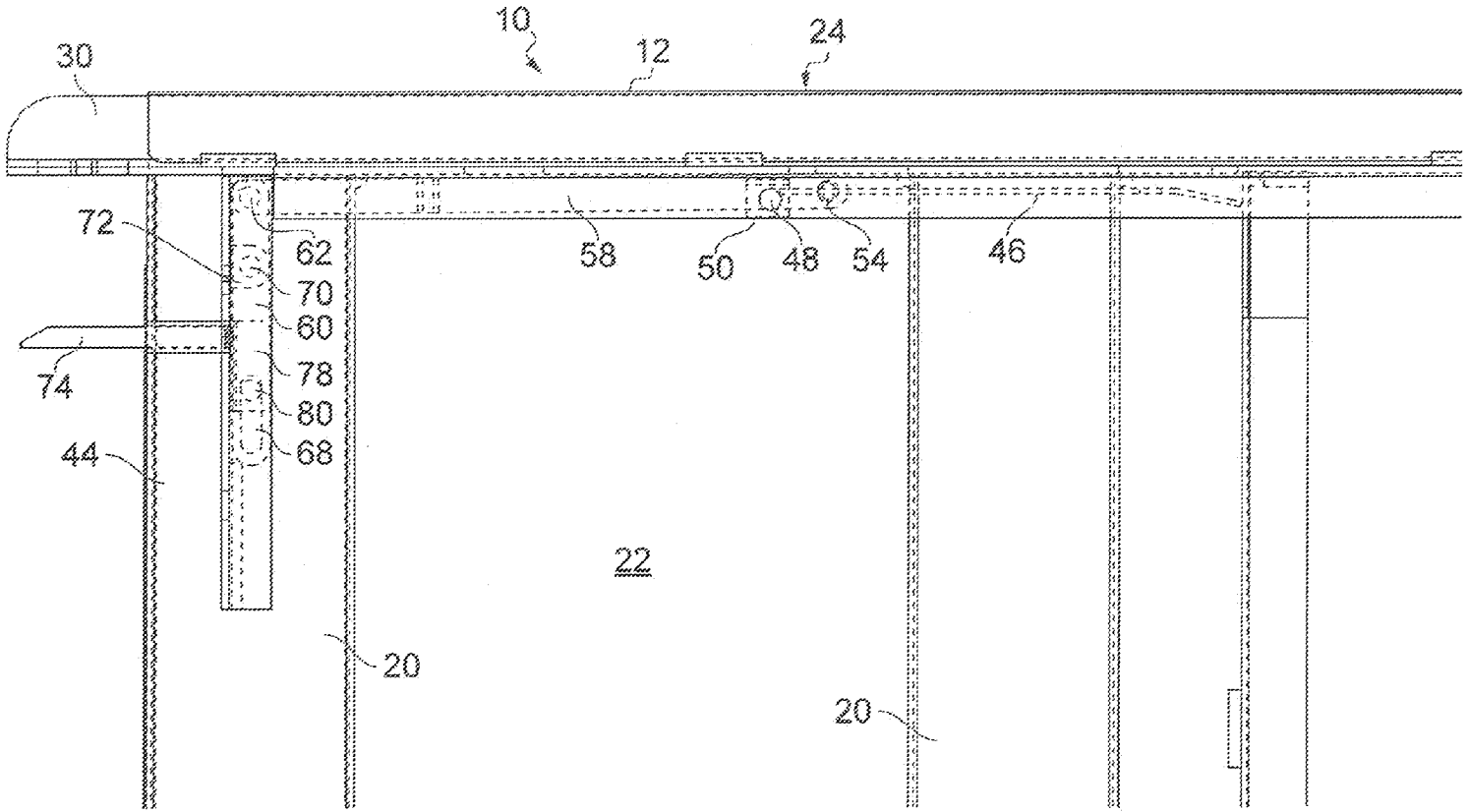
FIGS. 12 and 13 are schematic plan views of the locking mechanism, respectively in its locked and released condition.
Figure 13:
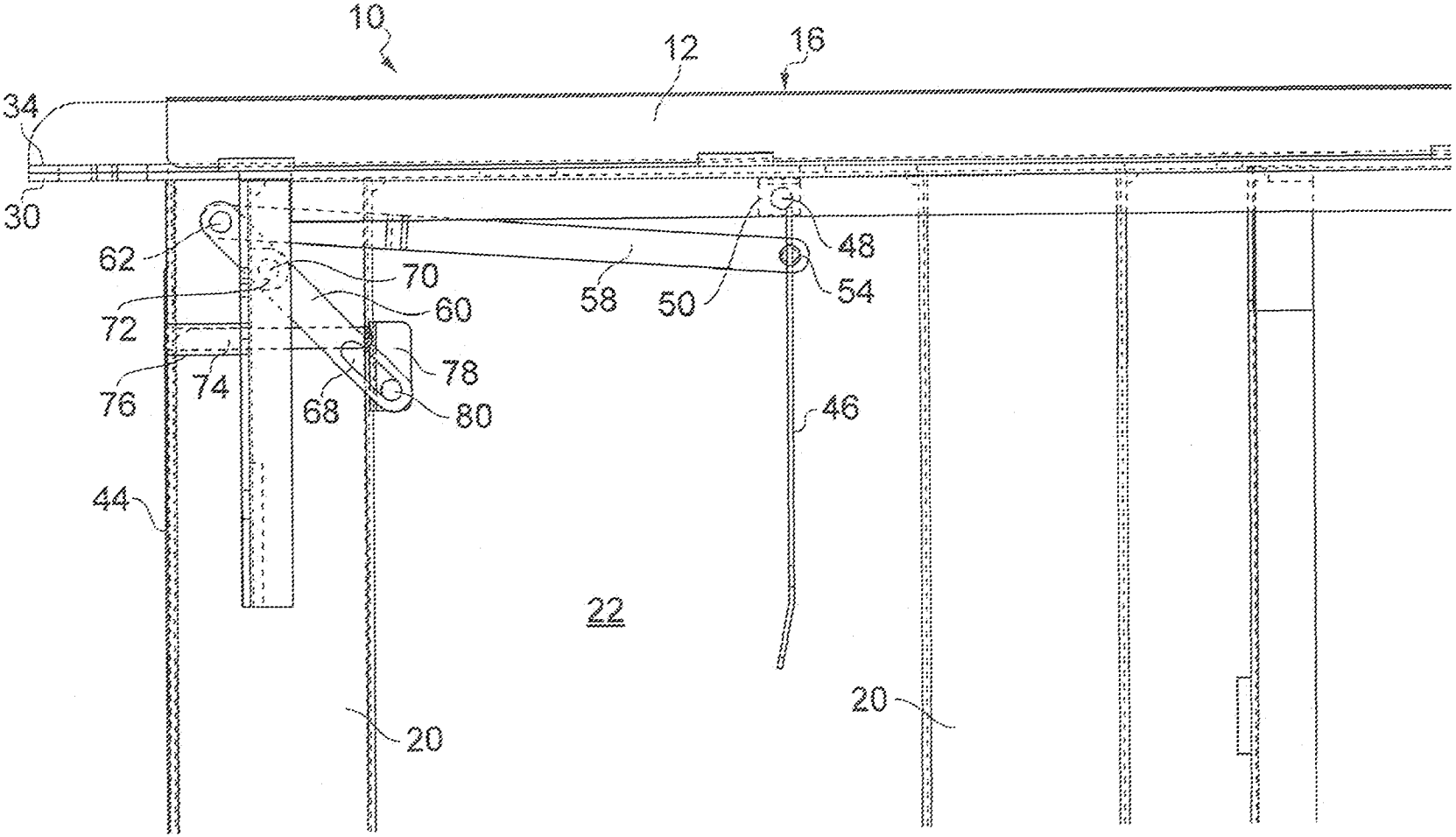
Figure 14:
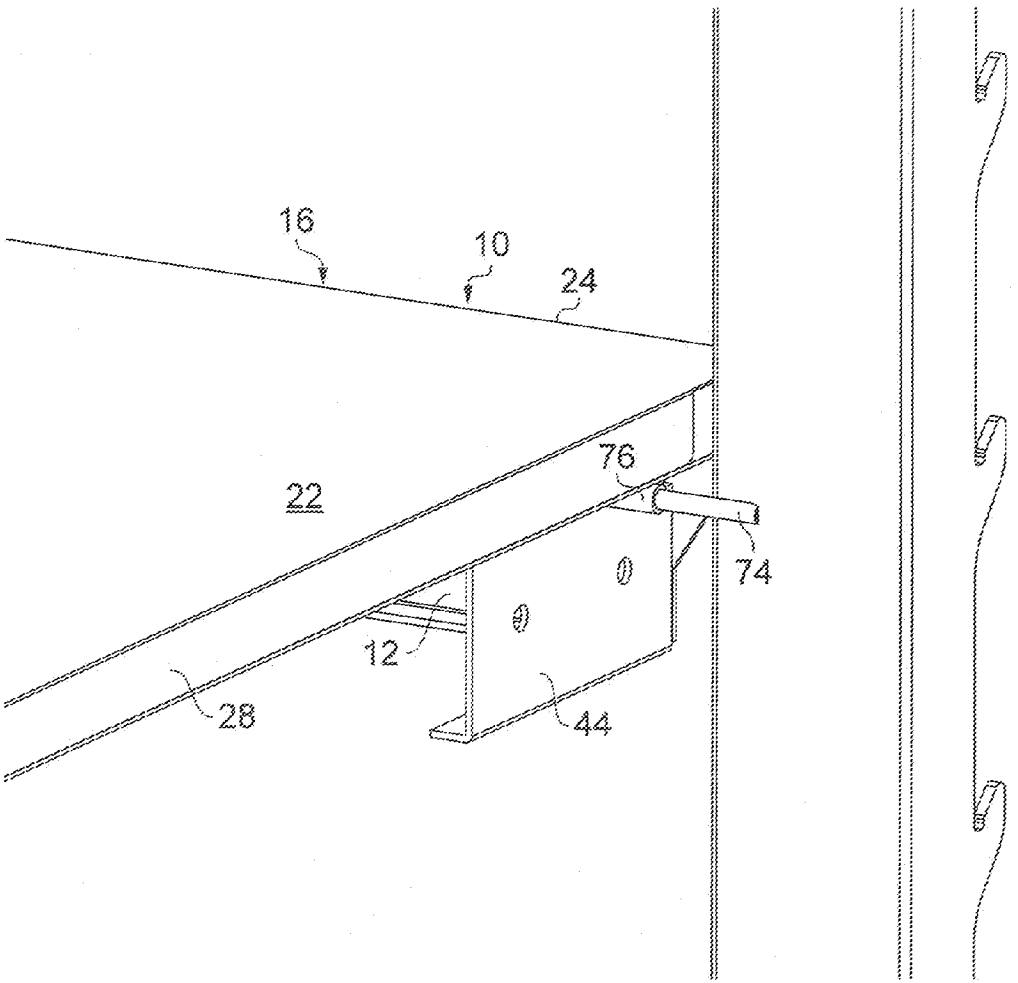
FIG. 14 is a partial section at a corner of a load support in position on racking, illustrating the function of the locking arrangement.

An elongate locking pin 74 is slidable in a sleeve 76 which is aligned with a corresponding aperture in the side gusset 44, so that the pin 74 may advance from the sleeve 76, through the side gusset 44 to the advanced position illustrated in FIG. 12, or may be withdrawn into the sleeve 76, as illustrated in FIG. 13.

In order to create this movement, the in-board end of the pin 74 carries a side arm 78 which in turn carries a pin 80 located in the slot 68. Accordingly, as the second bar 60 swings about the pin 70, the locking pin 74 is pulled or pushed into or out of the sleeve 76. Movement of the second bar 60 is in turn created by the first bar 58 pulling or pushing the second bar 60 and this movement, in turn, is created by hinged movement of the plate 46.

As has previously been noted, the plate 46 is positioned to be engaged by a tine being introduced into the corresponding aperture 32 to lift the pallet. Accordingly, the components illustrated in FIG. 10 form a coupling arrangement between the movable plate 46 and the locking pin 74 so that the locking pin 74 is caused to move as the plate 46 is moved by a tine. This coupling arrangement serves to convert hinged movement of the plate 46 to linear movement of the locking pin 74.

It may be desirable to provide an aperture 82 in the plate 46, and an aligned aperture in the front plate 12, to allow a padlock or other locking arrangement to lock the plate 46 in its closed position. This prevents the pallet 10 being removed from a racking system, because the arrangement for releasing the locking pin 74 is then disabled.

The front and rear plates 12, 14 and the gussets 44 are finished at their exposed edges by short in-turned flanges. In the default position (with the plate 46 closing the aperture 32, and the locking pin 74 fully extended), the components of FIG. 10 are contained within the volume of the front plate 12 and corresponding gusset 44. That is, none of the components project beyond the channel defined by the flanges at the free edges of the front plate 12 and gusset 44, with the exception of the locking pin 74 which is projecting through the gusset 44. Accordingly, the coupling arrangements do not interfere with the nesting function described above.

When the hooks 30 of the pallet 10 are hung on a post 120 of a racking system (FIG. 14), to sit on hooks 122, the advanced locking pin 74 engages behind the post 120, to retain the pallet 10 on the racking. The torsion spring 52 causes the locking arrangement to be biased to this locked condition.

In the example illustrated, the pin 54 sits closer to the front plate 12 than does the pivot bar 48, as can be seen in FIG. 12. Accordingly, any attempt to release the lock by depressing the locking pin 74 into the sleeve 76 will tend to press the plate 46 against the front plate 12, thereby resisting the movement of the locking pin 74. However, the pin 54 is able to move away from the front plate 12 when the plate 46 is pushed in by a tine, resulting in the locking pin 74 being withdrawn, as has been described. This provides a simple form of further security, by resisting the release of the lock except by means of a tine.

Castors

Figure 15:
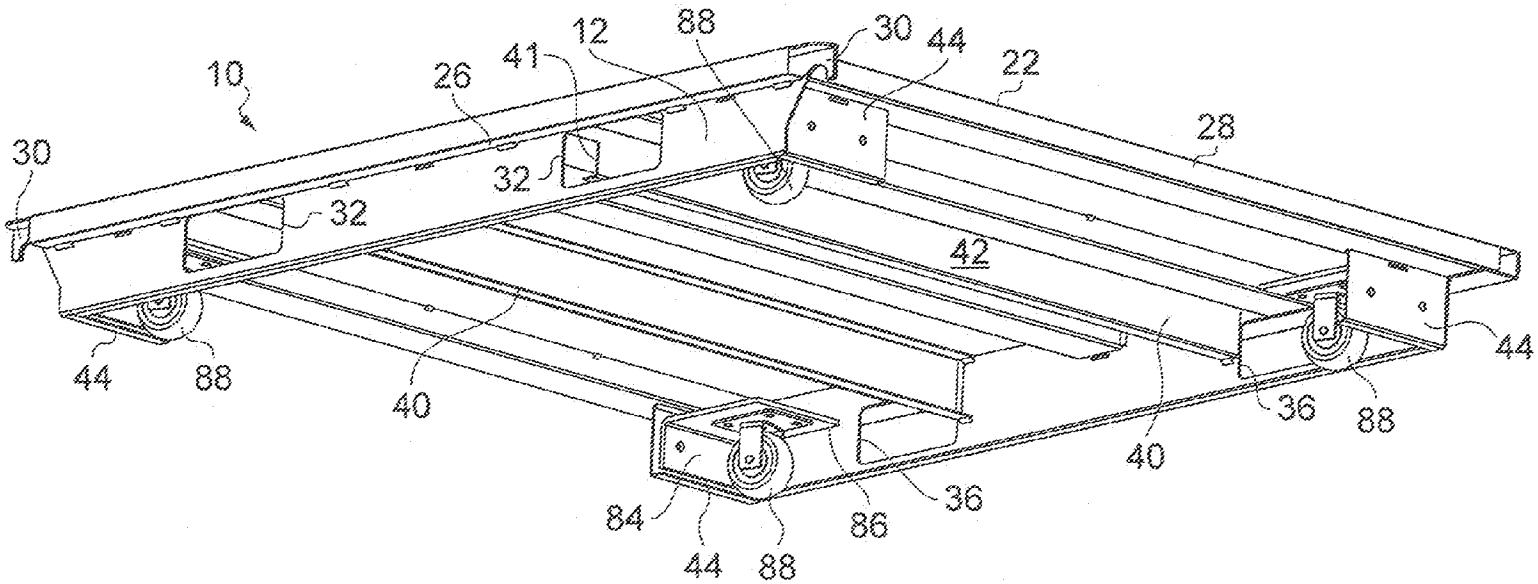
FIG. 15 is a perspective view of a load support from below, showing castor accessories fitted.

FIG. 15 illustrates the manner in which castors may be provided for the pallet 10, if desired. At each corner of the pallet 10, an L-shaped bracket 84 is secured to the inner face of the gusset 44 to provide a horizontal leg 86 to which a castor 88 is attached. The castor 88 projects sufficiently to extend below the lower edge of the front and rear plates 12, 14, and the gussets 44. This allows the pallet 10 to be supported by the castors 88 on the ground or another surface.

Securing Loads

Figure 16:
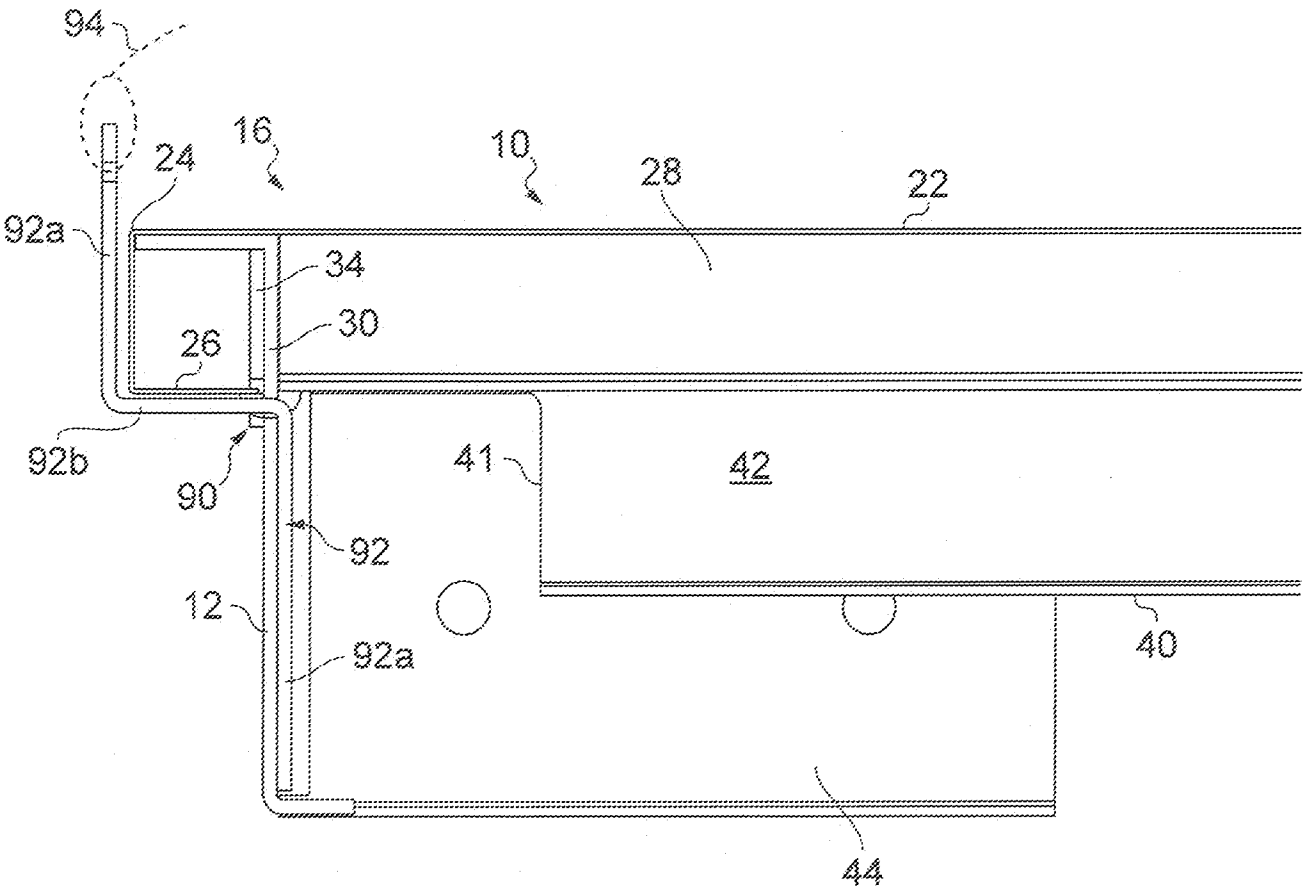
FIG. 16 is an enlarged partial section through the front of a load support at a position corresponding with the line 16-16 in FIG. 1, showing an additional accessory for securing loads.
Figure 17:
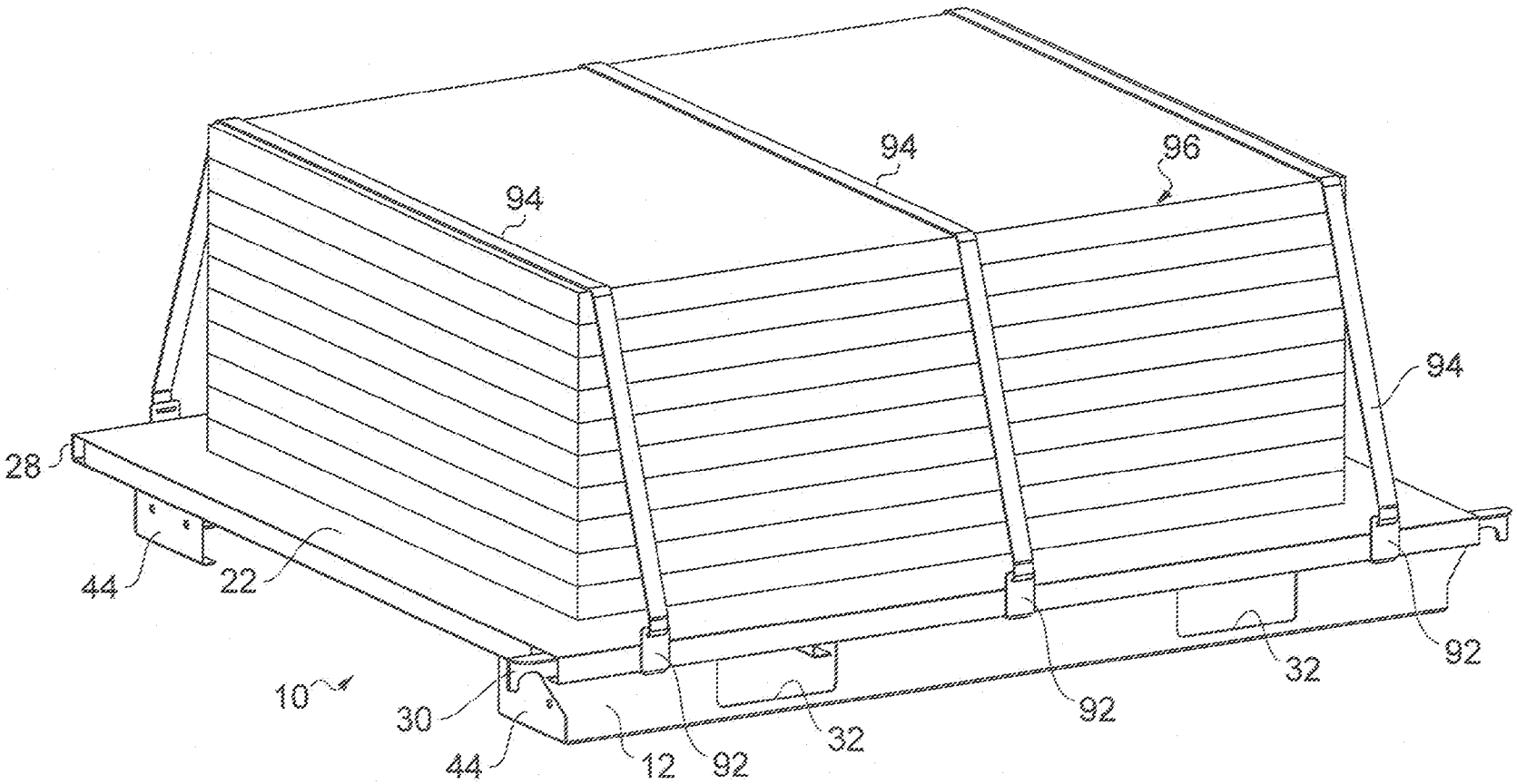
FIG. 17 is a perspective view of a load secured to the load support in this manner.

FIGS. 16 and 17 illustrate a minor modification which can be included to assist in securing loads to the pallet 10. Small slots 90 are provided near the top edge of the front and rear plates 12, 14 at several locations along their length. These receive brackets 92 which have two parallel legs 92*a* separated by a perpendicular mid portion 92*b*. One leg 92*a* is introduced through the slot 90 to leave the other leg 92*a* projecting up above the sheet 22. An eye in the exposed upper end of the bracket 92 allows a strap 94 to be secured as illustrated in FIG. 16, to secure a load 96 to the pallet 10.

Partitions

Figure 18:
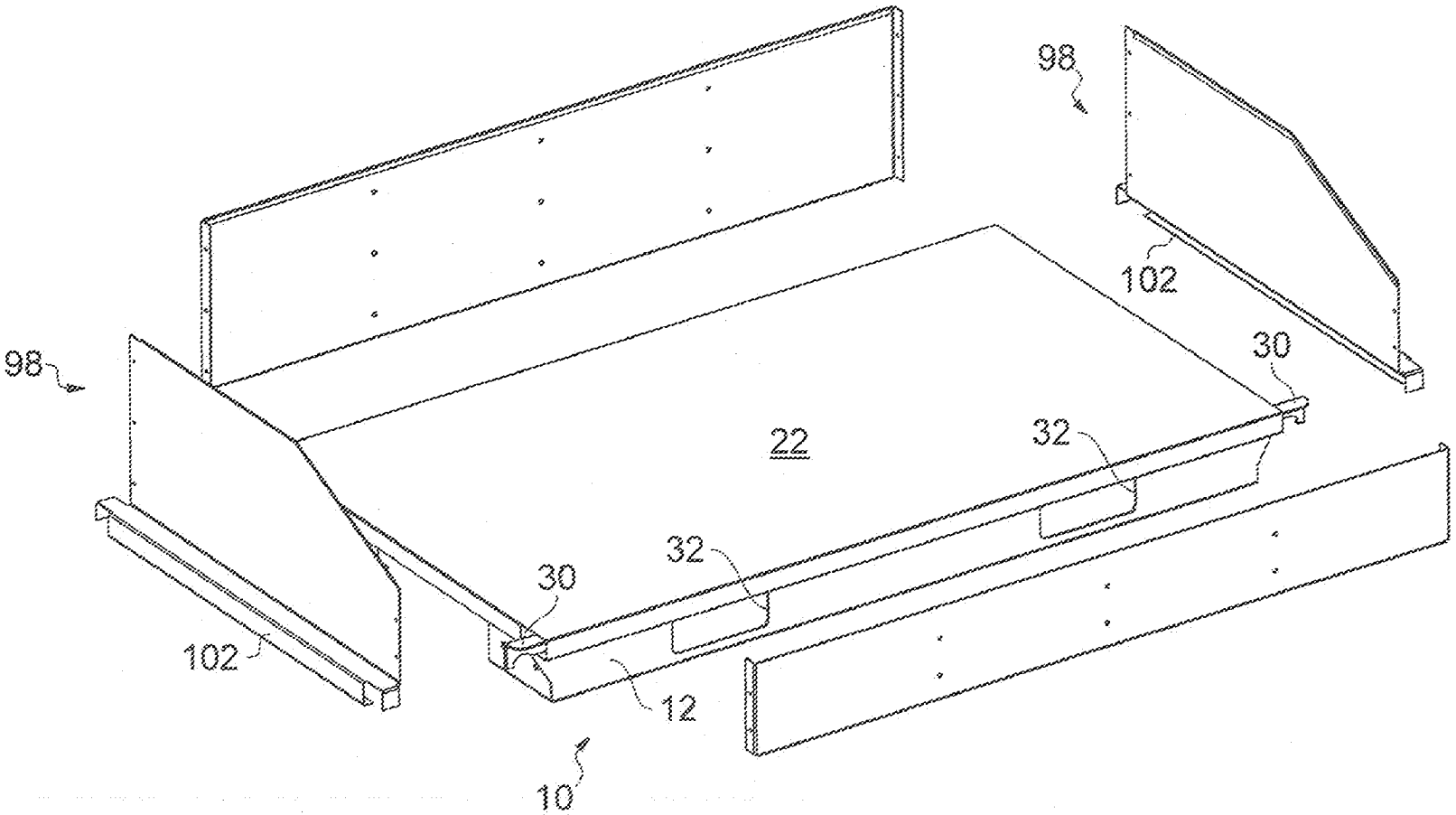
FIGS. 18 and 19 are, respectively, an exploded and assembled view of accessories for partitioning a supported load.
Figure 19:
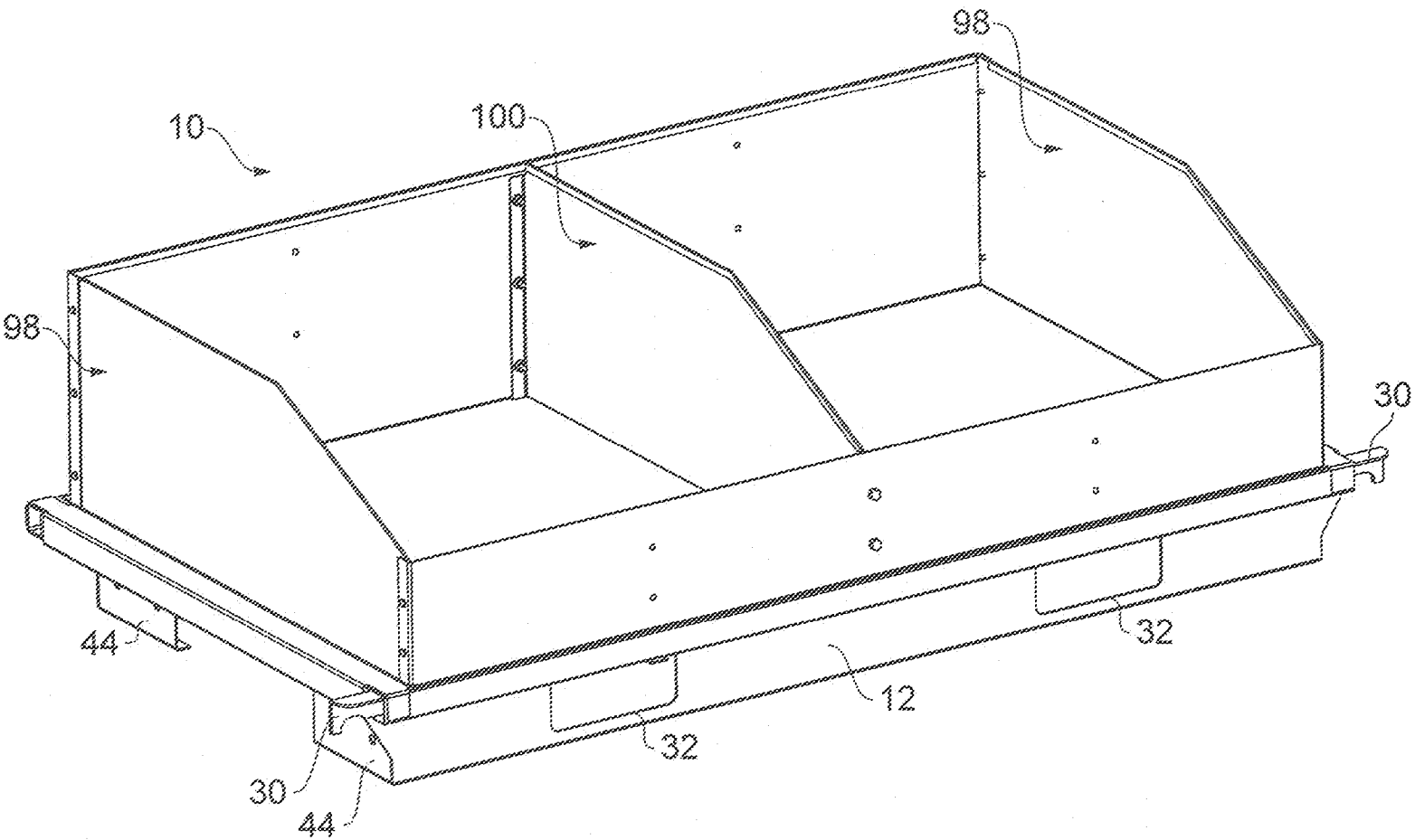

FIGS. 18 and 19 illustrate optional additional components in the form of walls 98 and a partition 100. Each of the walls 98 has a generally planar upper part and a channel section running along the lower edge, to fit over the edge of the sheet 22, to convert the upper surface of the pallet 10 to an enclosed tray. The walls 98 may also support one or more partitions 100, to sub-divide the tray.

Bin Array

Figure 20:
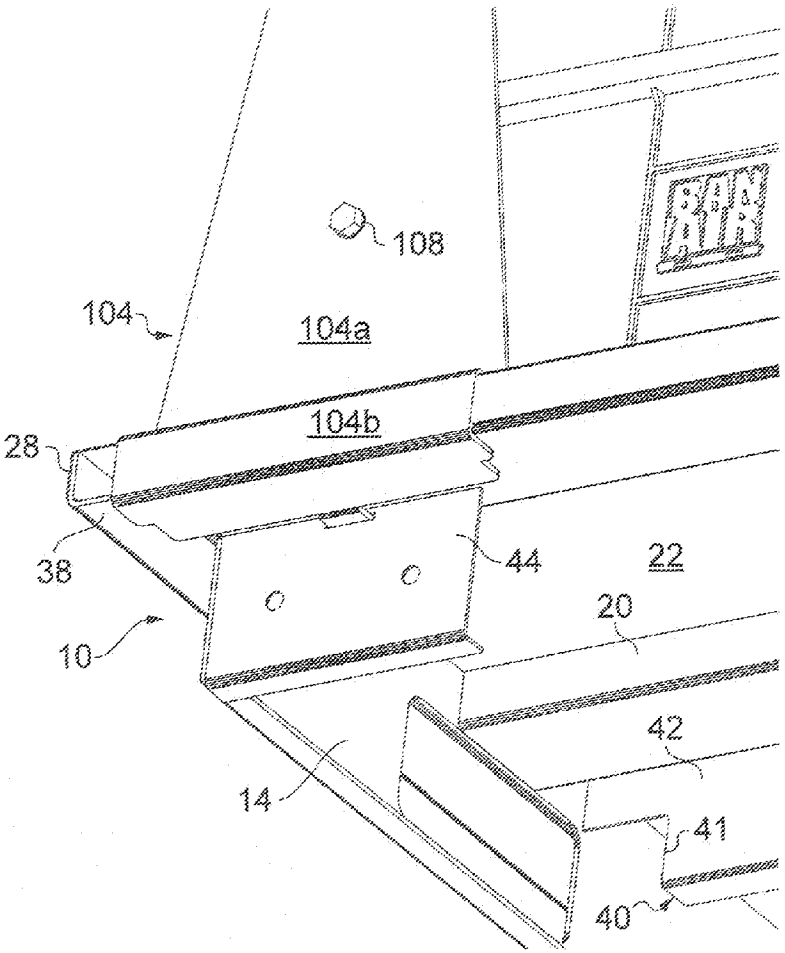
FIG. 20 is a partial perspective view from below, showing an alternative optional accessory for supporting an array of bins.
Figure 21:
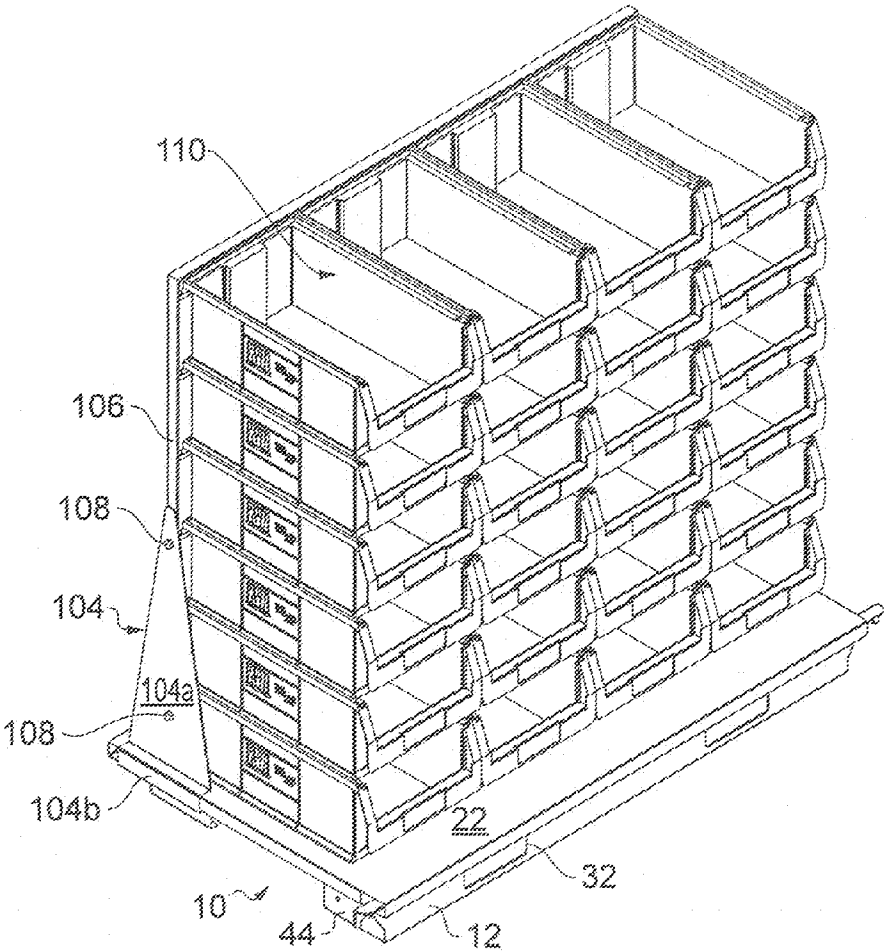
FIG. 21 is a perspective view of a load support with bins supported by means of the accessory of FIG. 20.

FIG. 20 illustrates a bracket 104 attached to the pallet 10 in a manner similar to the walls 98 of FIGS. 17 and 18. That is, the bracket 104 has an upper portion 104*a* and a channel section 104*b* fitting around the edge of the sheet 22. The upper portion 104*a* provides a mount for a back board 106 secured to the bracket 104 by bolts at 108. Two brackets 104 would preferably be provided, at opposite sides of the pallet 10. The back board 106 provides a support for an array of trays 110, which may be plastic storage trays of conventional form.

Cage

Figure 22:
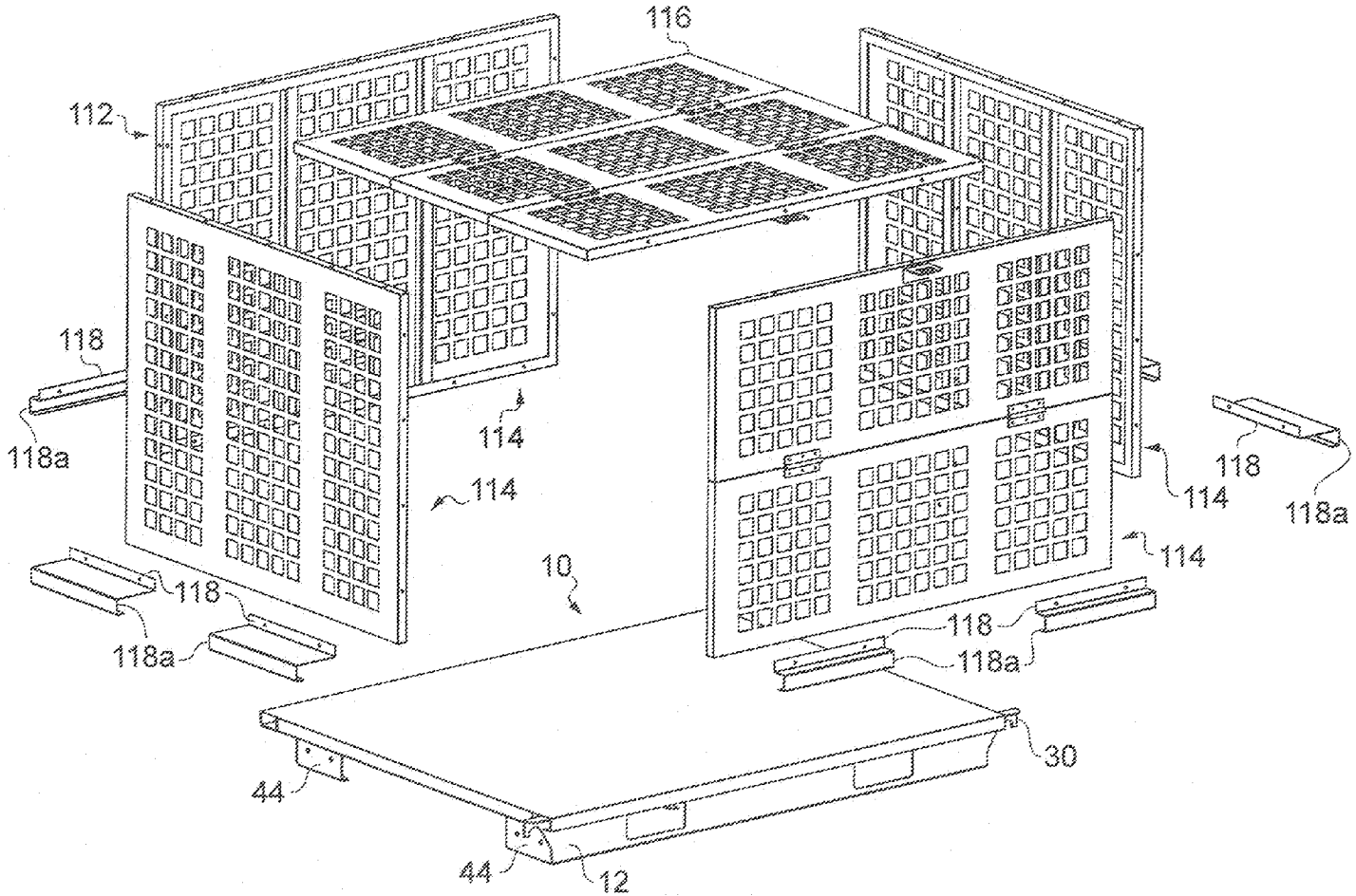
FIGS. 22 and 23 illustrate (respectively in exploded and assembled form) an optional cage accessory attached to the load support.
Figure 23:
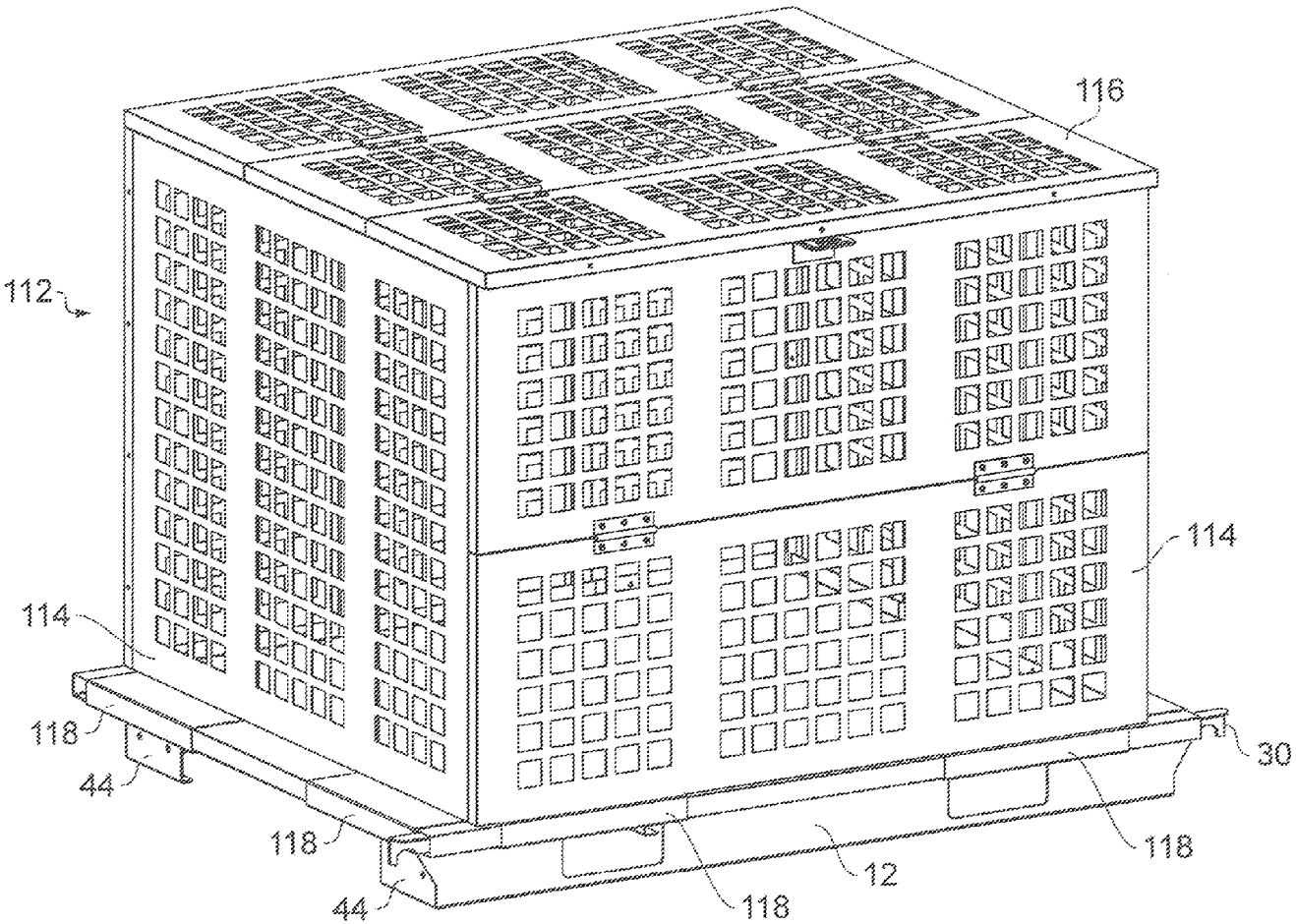

FIGS. 22 and 23 illustrate a mesh cage 112 which may be formed and secured to the pallet 10, to provide for secure storage of loads on the pallet 10.

The cage 112 is formed by wall panels 114 and a roof panel 116. The panels 114, 116 may be rigid or may be articulated by hinges. For example, this would allow the cage 112 to be opened. The lower edge of each panel 114, 116 carries a bracket 118 which has a channel section 118*a* to fit around the edge of the sheet 22, in the manner described above in relation to the bin array of FIG. 20.

Many other designs of cage construction could be envisaged.

Tyre Support

Figure 25:
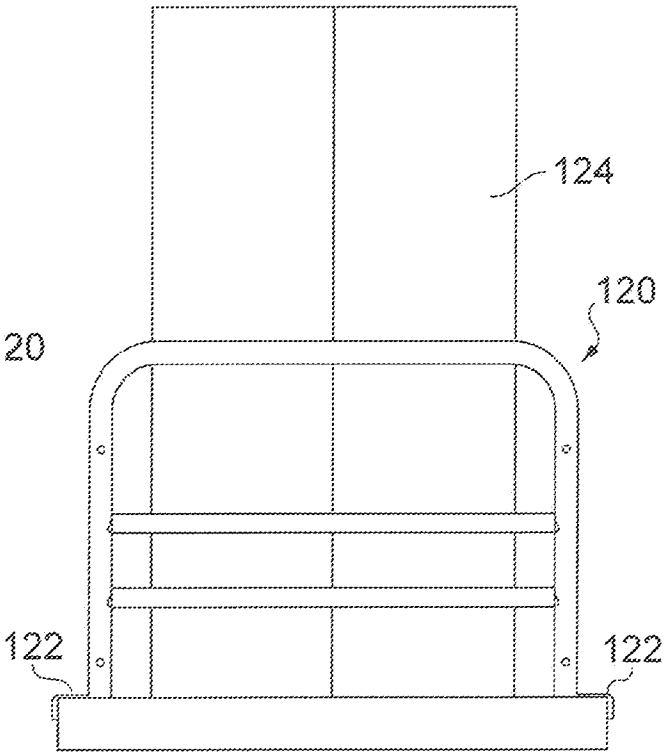
FIGS. 24 and 25 are side and end elevations of a tyre support.
Figure 24:
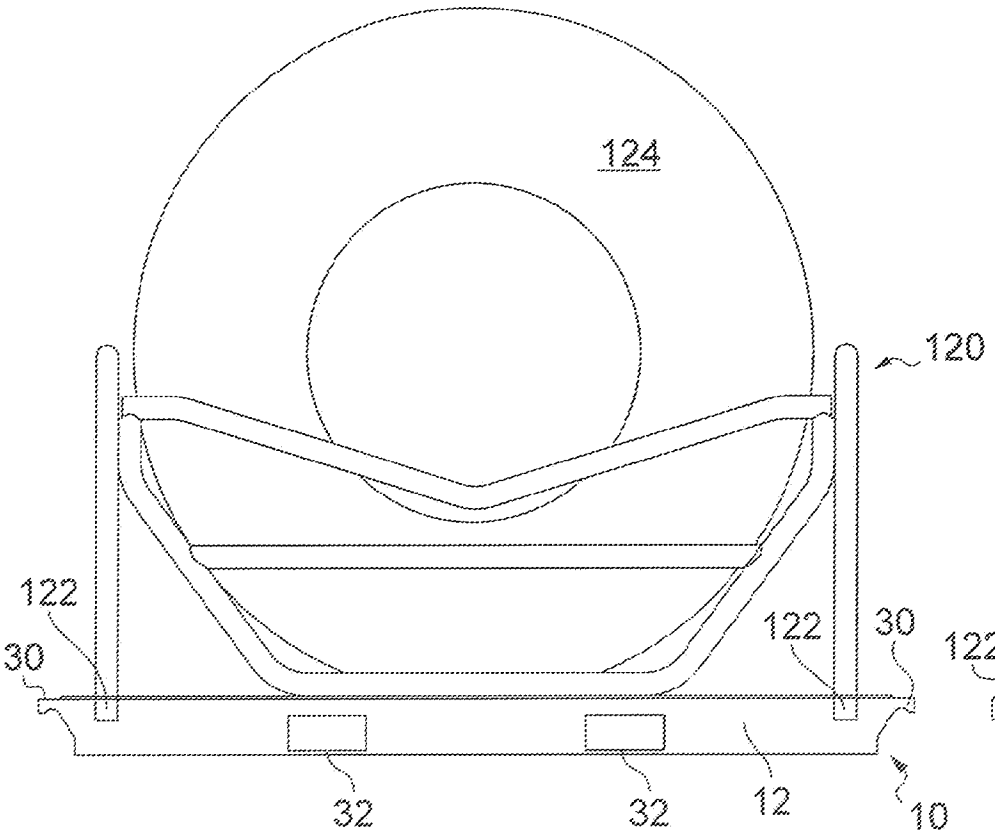

FIGS. 24 and 25 illustrate another example of a superstructure for the pallet 10. In this example, a frame 120 is provided, having channel section brackets 122 around its lower edge, for fitting around the edge of the sheet 22, in the manner described above in relation to the bin array and the cage. The frame 120 is shaped to receive and stably hold tyres 24.

The strap arrangements, partitions, bins, cage and tyre support just described are all examples of structures detachably mounted to the supporting frame to retain a load supported by the pallet. Other examples could be envisaged.

Mesh Pallet

Figure 26:
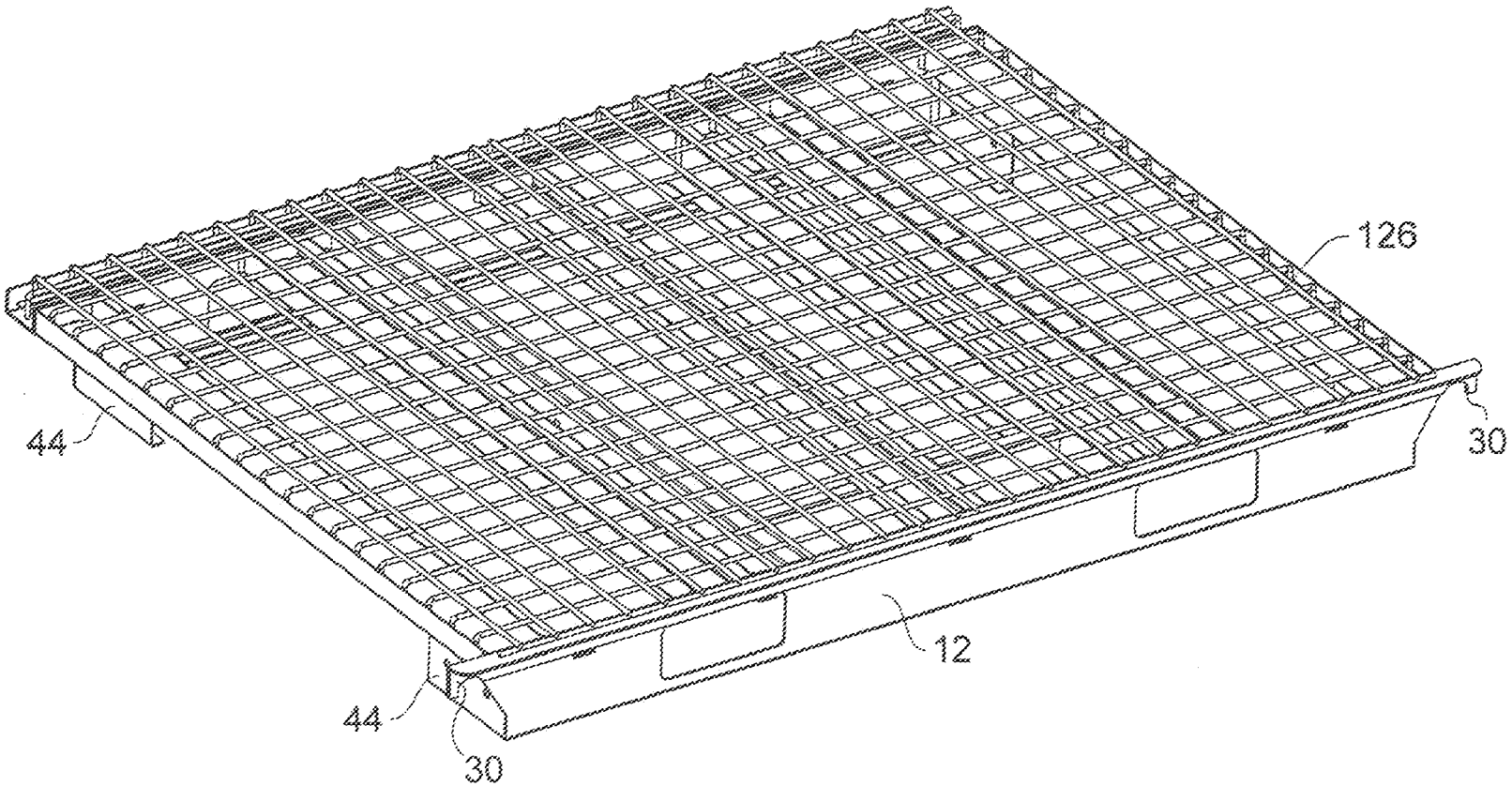
FIG. 26 is a perspective view of a mesh pallet.

FIG. 26 illustrates a further version of the pallet 10. The pallet illustrated in FIG. 26 corresponds very closely with the pallets described above and illustrated in the previous drawings. The principal difference relates to the upper surface of the pallet 10. In the example of FIG. 26, the upper surface is provided by a mesh sheet 126.

In a further alternative, not shown, the sheet member 22 or mesh sheet 126 may be omitted altogether, leaving the frame members 20 exposed from above, to define the upward extremity of the pallet.

Concluding Comments

Many variations and modifications can be made to the apparatus described above, without departing from the scope of the invention. It is envisaged that the components will primarily be metal, for use in high load applications, but other materials could be used. Many different shapes, forms, dimensions and relative dimensions could be adopted, according to the nature of the loads with which the apparatus is to be used.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A load support comprising:

a first member extending along a first edge region of the load support;

a second member extending along a second edge region of the load support and generally opposite to the first edge region;

at least one frame member extending between and attached to the first and second members;

the said members defining a supporting frame for bearing the weight of a load on the load support, and wherein the supporting frame is interfittable with the supporting frame of an inverted other like load support to allow the load supports to be nested when not in use;

the load support further comprising engagement means which, in use, engage a racking system for mounting the load support on the racking system, and wherein the engagement means have a locked condition to retain the load support on the racking system, in use, and wherein the engagement means are releasable, when in the locked condition, by interaction with a lifting tine and comprise (i) a further member positioned to be engaged by a tine and movably mounted to be moved, in use, by engagement with a tine which is introduced to lift the load support, (ii) a locking member, the locking member having a locking position in which the engagement means is locked, and a release position, and (iii) a coupling arrangement, the coupling arrangement providing a coupling between the further member and the locking member and the coupling causing the locking member to move, in use, between the locking position and the release position as the further member is moved by engagement with a tine.

2. A load support according to claim 1, wherein the supporting frame defines a plane for load support, the plane being generally upwardly directed, during use.

3. A load support according to claim 2, wherein at least one of the first member, the second member and the frame members is bounded by the plane.

4. A load support according to claim 1, wherein the frame members are exposed from above, to support a load resting directly on the frame members.

5. A load support according to claim 1, wherein the load support further comprises an upper surface member supported by the supporting frame and providing the upper surface of the load support.

6. A load support according to claim 5, wherein the upper surface member is a sheet member or a mesh member.

7. A load support according to claim 1, wherein when the supporting frames of like load supports are interfitted, the first and second members of each load support rest against the or a frame member of the other load support.

8. A load support according to claim 1, wherein the supporting frame defines a plane for load support and wherein the or each frame member extends away from the plane by first a distance and wherein the first and second members extend away from the plane by a second distance, and wherein the first distance is less than the second distance.

9. A load support according to claim 1, wherein the first and/or second member forms a skirt which extends downwardly in use, there being at least one aperture formed in the skirt, to receive a lifting tine.

10. A load support according to claim 9, wherein a guide member is associated with the or each aperture, to maintain alignment of the tine, relative to the load support.

11. A load support according to claim 1, wherein the engagement means are biased to their locked condition.

12. A load support according to claim 1, wherein the further member is mounted for hinged movement, the locking member is mounted for linear movement, and the coupling arrangement couples the locking member for linear movement as the further member undergoes hinged movement.

13. A load support according to claim 1, wherein the coupling arrangement causes movement of the locking member away from the locking position to press the further member to a locking position which corresponds with the locking position of the locking member.

14. A load support according to claim 1, wherein the further member is lockable in the locking position of the further member.

15. A load support according to claim 1, further comprising castors on which the support is supportable on the ground or other surface.

16. A load support according to claim 1, comprising at least one of a structure detachably mounted to the supporting frame to retain a load supported by the support, and slots operable to secure a strap for securing a load.

17. A load support according to claim 1, further comprising engagement means which, in use, engage a racking system for mounting the load support and a supported load on the racking system, the engagement means being releasably lockable by interaction with a lifting tine introduced to lift the load support.

* * * * *